US008081054B2

(12) United States Patent
Guentert, III et al.

(10) Patent No.: US 8,081,054 B2
(45) Date of Patent: Dec. 20, 2011

(54) HYPER-COOLED LIQUID-FILLED TRANSFORMER

(76) Inventors: Joseph J. Guentert, III, Charlotte, NC (US); Brian T. Steinbrecher, Brookfield, WI (US)

( * ) Notice: Subject to any disclaimer, the term of this patent is extended or adjusted under 35 U.S.C. 154(b) by 105 days.

(21) Appl. No.: 12/763,312

(22) Filed: Apr. 20, 2010

(65) Prior Publication Data

US 2011/0140820 A1 Jun. 16, 2011

Related U.S. Application Data

(60) Provisional application No. 61/284,001, filed on Dec. 10, 2009.

(51) Int. Cl.
*H01F 27/10* (2006.01)

(52) U.S. Cl. ..... 336/58

(58) Field of Classification Search ..... 336/55–62, 336/90, 92

See application file for complete search history.

(56) References Cited

U.S. PATENT DOCUMENTS

| | | | | |
|---|---|---|---|---|
| 1,394,044 | A * | 10/1921 | Stephens | 336/61 |
| 3,975,137 | A | 8/1976 | Hapgood | |
| 4,208,655 | A * | 6/1980 | Phillips | 340/627 |
| 4,577,175 | A * | 3/1986 | Burgher et al. | 336/61 |
| 4,993,235 | A | 2/1991 | Frantl | |
| 5,097,241 | A | 3/1992 | Smith et al. | |
| 5,940,347 | A | 8/1999 | Raida et al. | |
| 6,399,876 | B1 | 6/2002 | Oakes | |
| 6,401,518 | B1 | 6/2002 | O'Keeffe et al. | |
| 6,424,266 | B1 | 7/2002 | Weekes et al. | |
| 6,601,641 | B1 | 8/2003 | Stefanik et al. | |
| 6,609,079 | B1 | 8/2003 | Seitlinger | |
| 6,727,821 | B2 | 4/2004 | Weekes et al. | |
| 6,858,157 | B2 | 2/2005 | Davidson et al. | |
| 6,909,349 | B1 | 6/2005 | Longardner et al. | |
| 7,227,754 | B2 | 6/2007 | Griesinger et al. | |
| 7,390,428 | B2 | 6/2008 | Davidson et al. | |
| 2004/0255604 | A1 | 12/2004 | Longardner | |
| 2008/0000627 | A1 | 1/2008 | Noguchi et al. | |
| 2008/0012436 | A1 | 1/2008 | Neal | |
| 2008/0029254 | A1 | 2/2008 | Sekito et al. | |

* cited by examiner

*Primary Examiner* — Tuyen Nguyen

(74) *Attorney, Agent, or Firm* — Ziolkowski Patent Solutions Group, SC

(57) ABSTRACT

A transformer is disclosed that includes a housing having a core-winding assembly positioned therein that is immersed in a dielectric transformer fluid contained within the housing. A cooling system is provided to cool the dielectric transformer fluid contained within the housing and includes a closed-loop fluid path having a quantity of dielectric cooling fluid that is circulated there through and that is maintained separate from the dielectric transformer fluid. A liquid-to-liquid heat exchanger is positioned along the closed-loop fluid path and within the housing so as to be immersed within the dielectric transformer fluid, with the liquid-to-liquid heat exchanger cooling the dielectric transformer fluid based on a liquid-to-liquid transfer of heat energy between the dielectric cooling fluid and the dielectric transformer fluid. The cooling system also includes a heat dissipation system positioned remotely from the liquid-to-liquid heat exchanger to cool the dielectric cooling fluid circulating through the closed-loop fluid path.

20 Claims, 8 Drawing Sheets

HYPER-COOLED LIQUID-FILLED TRANSFORMER

CROSS-REFERENCE TO RELATED APPLICATION

The present application is a non-provisional of, and claims priority to, U.S. Provisional Patent Application Ser. No. 61/284,001, filed Dec. 10, 2009, the disclosure of which is incorporated herein by reference.

BACKGROUND OF THE INVENTION

Embodiments of the present invention relate generally to liquid-filled power transformers, and, more particularly, to a system for cooling such transformers to minimize externally radiated heat, while providing a smaller footprint and thus more options for deploying such a transformer.

Transformers, and similar devices, come in many different shapes and sizes for many different applications and uses. Fundamentally, all of these devices include at least one primary winding(s) with at least one core path(s) and at least one secondary winding(s) wrapped around the core(s). When a varying current (input) is passed through the primary winding a magnetic field is created which induces a varying magnetic flux in the core. The core is typically a highly magnetically permeable material which provides a path for this magnetic flux to pass through the secondary winding thereby inducing a voltage on the secondary (output) of the device.

Power transformers are employed within power distribution systems in order to transform voltage to a desired level and are sized by the current requirements of their connected load. If a load is connected to the secondary, an electric current will flow in the secondary winding and electrical energy will be transferred from the primary circuit, through the transformer, to the load. Transformers are designated by their power rating, typically in kVA, which describes the amount of energy per second that they can transfer and also by their primary and secondary operating voltages, typically in kV. Medium power transformers can be rated up to 10,000 kVA and up to 46 kV while large power transformers can be rated up to 120,000 kVA and up to 345 kV.

One shortcoming of existing transformers is their susceptibility to operational problems associated with high temperatures of operation, both internal and external to the transformer. The largest source of heat in a transformer is heat created by the load current flowing through windings of the core-winding assembly, based on the inherent resistance of the wire from which the windings are constructed. High temperatures for long periods of time in transformers will destroy insulation positioned about and between the windings, thereby leading to a transformer failure. During the design of power transformers, considerable effort is spent to: reduce losses so as to decrease the generation of heat in the windings; move heat away from the windings (i.e., provide cooling) and spread the heat out by physical design (i.e., provide heat dissipation); and improve the winding insulation so that it can withstand greater exposure to heat.

With regard to providing cooling to the transformer windings and heat dissipation from the transformer, one common solution in to construct the transformer as a liquid-filled transformer. In a typical liquid-filled power transformer, a bath of dielectric insulating liquid is contained within the housing of the transformer, with the core and windings of the transformer being submerged in the dielectric insulating liquid. Moving heat away from the windings is accomplished by direct contact of the windings with the dielectric insulating liquid. The denser the dielectric insulating liquid the better the heat transfer and, as such, the typical liquids used are selected both for their dielectric properties (insulating the high voltage) as well as their heat transfer properties.

In operation of a liquid-filled transformer, it is recognized that as heat is moved away from the windings and transferred to the dielectric fluid, a heat-exchanging mechanism for dissipating heat in the dielectric fluid is required. One existing type of liquid-filled power transformer is shown in FIG. 1, with the transformer 100 including a housing 102 having a dielectric liquid 104 therein that immerses a core 106 and winding 108. The transformer 100 includes external radiators 110 exposed to ambient air, which provide the dielectric insulating liquid 104 a path to circulate through a region of increased surface area for the purpose of liquid-to-air heat exchange to cool the dielectric insulating liquid 104. The radiators 110, through convection, move the hot liquid 104 through a series of channels 112 providing more surface area for the air outside of the housing 102 to contact the radiator 110 to remove heat from the liquid 104. To provide improved cooling, the radiators 110 are often equipped with large fans 114 to provide additional forced-air cooling. To provide further improved cooling, the radiators 110 with, or without, fans 114 are often connected to the housing 102 through large pumps 116 to provide additional forced-oil cooling. However, the addition of radiators 110, associated fan systems 114, and associated pump systems 116 external to the main housing 102 of the transformer 100 comes as a tradeoff in transformer size and cost, and often doubles the footprint of the transformer 100.

Another existing type of liquid-filled power transformer is shown in FIG. 2, with the transformer 120 including a heat-exchanging mechanism in the form of a secondary cooling loop or system 122 that provides for liquid-to-liquid cooling of dielectric insulating liquid 104 diverted out of the transformer 120. Secondary cooling system 122 is in the form of a forced water cooled unit, for example, that includes a cooling unit/heat exchanger 124 that pumps water 126 to/through a radiator unit 128. Radiator unit 128 is positioned with a reservoir 130 which is configured to hold a quantity of dielectric insulating liquid 104 pumped out from housing 102 by way of pumps 116. The dielectric insulating liquid within reservoir 130 is cooled by way of a liquid-to-liquid transfer of heat energy with water 126 of cooling system 122. However, similar to the system of FIG. 1, the addition of reservoir 130, radiator unit 128 and heat exchanger 124 external to the main housing 102 of the transformer 100 comes as a tradeoff in transformer size and cost, and often doubles the footprint of the transformer 100.

Still another existing type of liquid-filled power transformer provides for diverting of dielectric insulating liquid out of the transformer housing to a remote heat exchanger unit. However, cooling of the dielectric insulating liquid in such a manner is limited by the amount of work it adds to the dielectric liquid to move it out of the insulating/dielectric environment and to the heat exchanger. That is, the work (e.g., pumping) done on the dielectric liquid can cause frothing and foaming, and if the dielectric liquid is left in this frothed state upon reentry into the transformer, the dielectric strength and heat transfer capability of the liquid will be severely compromised. Another disadvantage of this type of system is that if the piping between the transformer and the remote heat exchanger were to develop a leak, the amount of insulating liquid in the transformer would decrease to a level that may be insufficient for operation of the transformer, thereby leading to an eventual failure of the transformer. Lastly, this type of increased path for the dielectric insulating liquid leads to an increased likelihood of contaminants being introduced into the liquid, thereby resulting in a contaminated liquid having lower dielectric strength and heat transfer capability.

As a result of the existing transformer configurations set forth above, liquid-filled power transformers have historically been large in size (with respect to their rating) and thus have typically been located outdoors from a facility, such as on a rooftop or on a concrete pad in a fenced-in or controlled area. Such placement of the transformer necessitates running large secondary feeders for long distances at great cost to connect the transformer to its designated load center inside of a building.

Additional advancements in dielectric insulating liquid technology have brought about liquids that are less flammable and have improved dielectric properties. Such fluids have a higher fire point, thereby allowing for placement of the transformer inside of a building. Beneficially, placement of the transformer inside of a building (close to the load) allows for the length of the secondary cables for transferring power from the transformer to the load to be greatly reduced, which results in substantial cost savings in both materials and installation, as well as cost savings with respect to the long-term cost of continuous losses during normal everyday operation. However, drawbacks still exist regarding the placement of existing liquid-filled transformers indoors. For example, the inclusion of radiators and associated fan systems to the transformer still results in a large transformer. Additionally, the placement of existing liquid-filled, and dry-type, air-cooled transformers indoors also results in transferring heat from the normal operation of the transformer to the inside of the building (i.e., the liquid-to-air heat exchange from the radiator to the surrounding ambient environment), which then needs to be removed from the building.

Therefore, it would be desirable to provide a system and method for cooling a transformer that overcomes the disadvantages of known cooling techniques for liquid-filled transformers, especially for deployment indoors. It would further be desirable to provide a transformer cooling system and method to enable deployment of the liquid-filled power transformer in a building without adding heat to the building that would then need to be removed by the building air condition system. It would also be desirable to provide such a system and method that enables the size of the transformer to be reduced to optimize installation in a building.

BRIEF DESCRIPTION OF THE INVENTION

Embodiments of the invention are directed to a cooling system for a transformer that include a liquid-to-liquid heat exchanger positioned within a transformer housing and a heat dissipation system that is positioned remotely from the liquid-to-liquid heat exchanger. A quantity of cooling fluid is provided in the cooling system that is maintained separate from a transformer fluid contained within the transformer housing, with the cooling fluid providing for a liquid-to-liquid transfer of heat energy between the cooling fluid and the transformer fluid so as to provide cooling to the transformer, with heat being removed from the cooling fluid by the heat dissipation system at a remote location.

In accordance with one aspect of the present invention, a transformer includes a housing, a core-winding assembly positioned within the housing that includes a transformer core and a plurality of windings wound about the transformer core, a transformer fluid contained within the housing and immersing the core-winding assembly, and a cooling system configured to cool the transformer fluid contained within the housing. The cooling system includes a closed-loop fluid path having a quantity of cooling fluid that is circulated there through and a liquid-to-liquid heat exchanger positioned along the closed-loop fluid path and within the housing so as to be immersed within the transformer fluid, with the liquid-to-liquid heat exchanger configured to cool the transformer fluid contained within the housing based on a liquid-to-liquid transfer of heat energy between the cooling fluid and the transformer fluid. The cooling system also includes a heat dissipation system positioned remotely from the liquid-to-liquid heat exchanger and configured to cool the cooling fluid circulating through the closed-loop fluid path. The cooling fluid comprises a first dielectric fluid and the transformer fluid comprises a second dielectric fluid, with the first dielectric fluid being maintained separate from the second dielectric fluid.

In accordance with another aspect of the present invention, a transformer includes a transformer housing defining a main chamber and a side chamber, a core-winding assembly positioned within the main chamber of the transformer housing and having a transformer core and a plurality of windings wound about the transformer core, and a dielectric transformer fluid substantially filling the main chamber and the side chamber of the transformer housing such that the core-winding assembly is immersed in the dielectric transformer fluid. That transformer also includes a transformer cooling system configured to cool the dielectric transformer fluid contained within the main chamber and the side chamber of the transformer housing, with the transformer cooling system further including a closed-loop fluid path and a quantity of dielectric cooling fluid contained within the closed-loop fluid path that is circulated there through so as to be maintained separately from the dielectric transformer fluid. The transformer cooling system also includes a liquid-to-liquid heat exchanger included on the closed-loop fluid path and positioned within the side chamber of the transformer housing so as to be immersed within the dielectric transformer fluid and a heat dissipation system positioned remotely from the liquid-to-liquid heat exchanger and configured to cool the dielectric cooling fluid circulating through the closed-loop fluid path. The transformer cooling system is configured to selectively circulate a dielectric cooling fluid through the liquid-to-liquid heat exchanger to extract heat energy from the dielectric transformer fluid based on a liquid-to-liquid transfer of heat energy between the dielectric cooling fluid and the dielectric transformer liquid.

In accordance with yet another aspect of the present invention, a cooling system for providing cooling to a liquid-filled transformer includes a closed-loop fluid path, a quantity of cooling fluid contained within the closed-loop fluid path that is circulated through the closed-loop fluid path, and a liquid-to-liquid heat exchanger included in the closed-loop fluid path and being positioned within a housing of the liquid-filled transformer so as to be immersed in a transformer fluid contained within the housing, with the liquid-to-liquid heat exchanger configured to cool the transformer fluid based on a liquid-to-liquid transfer of heat energy between the cooling fluid and the transformer fluid. The cooling system also includes a heat dissipation system configured to cool the cooling fluid circulating through the closed-loop fluid path, with the heat dissipation system being positioned along the closed-loop fluid path remotely from the liquid-to-liquid heat exchanger. The cooling fluid is in the form of a first dielectric fluid and the transformer fluid is in the form of a second dielectric fluid.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION OF THE PREFERRED EMBODIMENT

The operating environment of the invention is described with respect to a liquid-filled transformer. A system is provided for cooling such a liquid-filled transformer so as to minimize externally radiated heat and provide a smaller transformer footprint.

Figure 1:
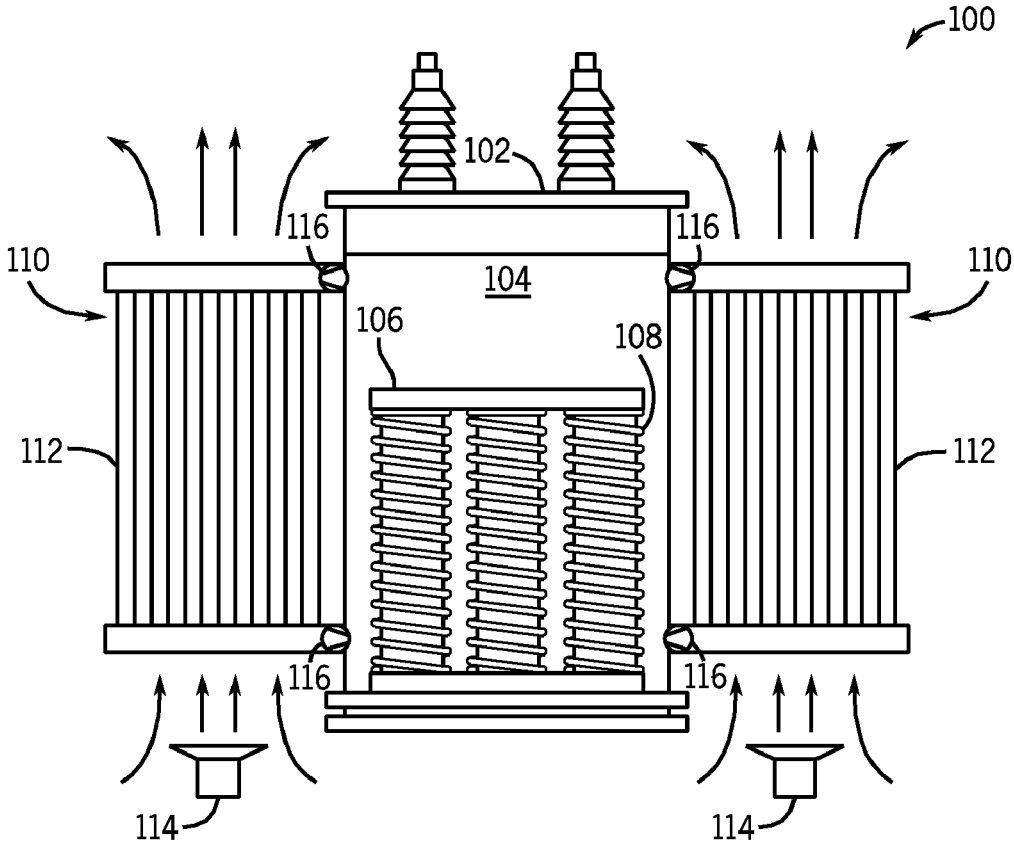
FIG. 1 PRIOR ART
FIG. 1 is a schematic view of a prior art liquid-filled transformer and associated cooling system.
Figure 2:
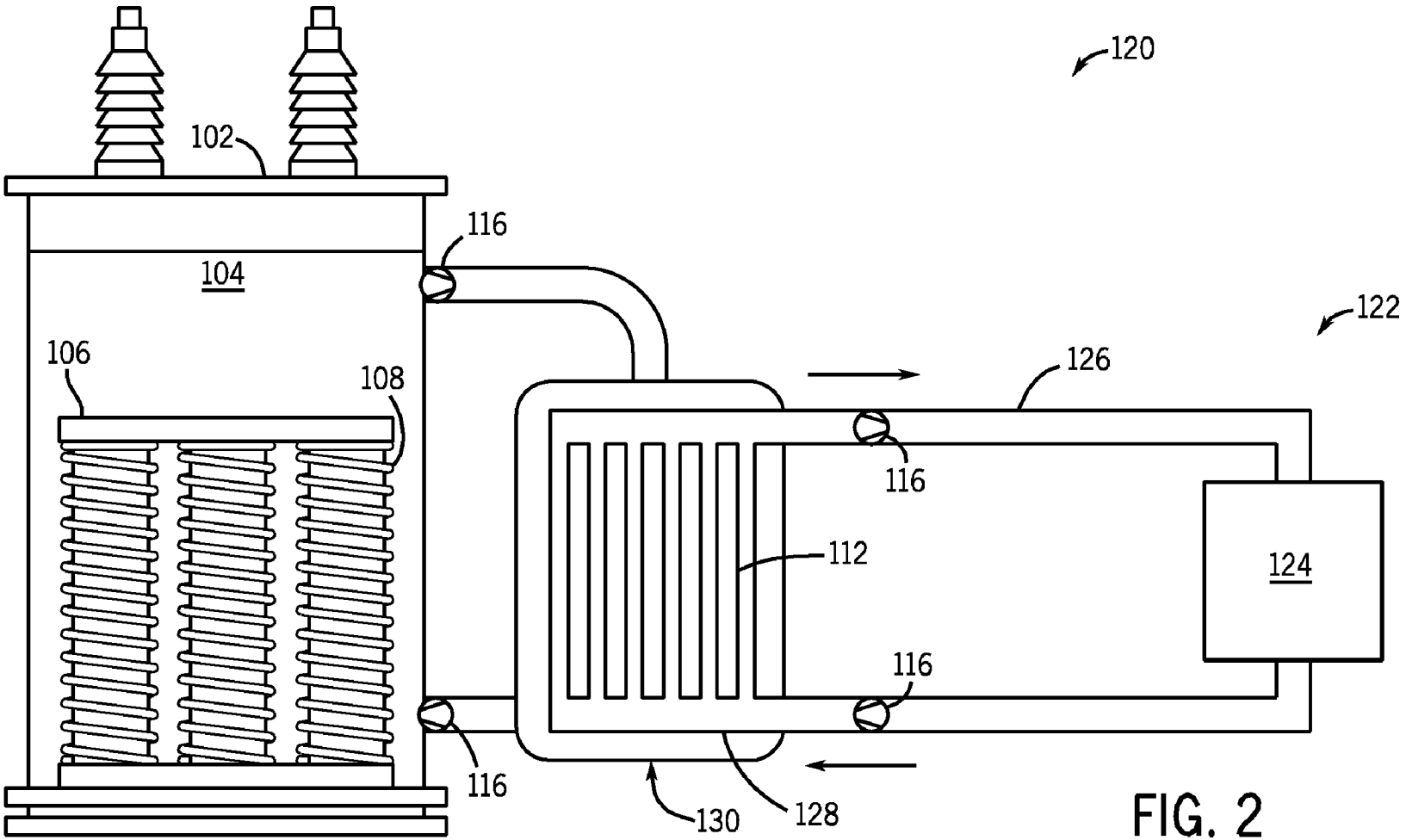
FIG. 2 PRIOR ART
FIG. 2 is a schematic view of a prior art liquid-filled transformer and associated cooling system.
Figure 3:
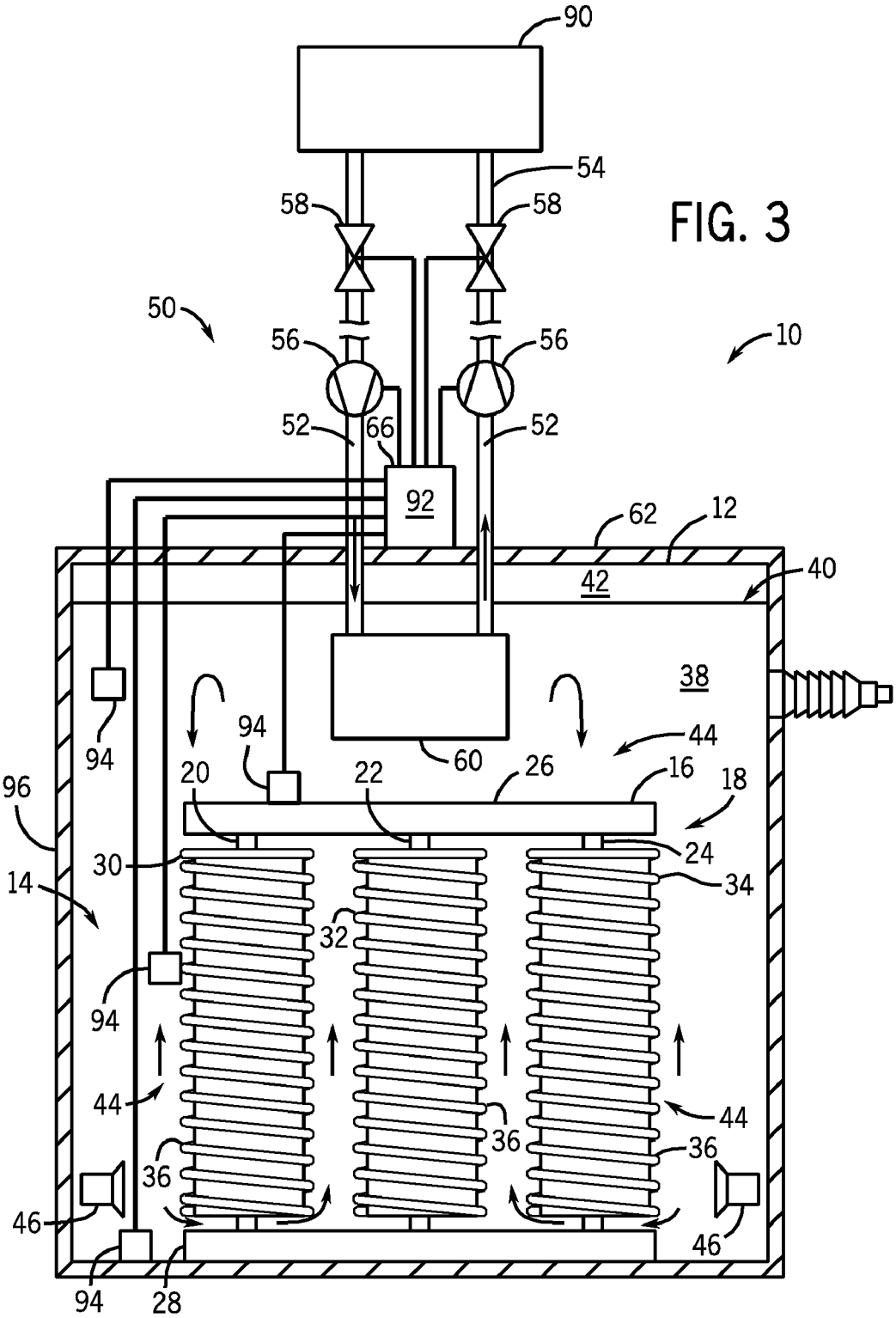
FIG. 3 is a schematic view of a liquid-filled transformer and associated cooling system according to an embodiment of the invention.

Referring to FIG. 3, a power transformer 10 is shown according to an embodiment of the invention. The transformer 10 includes a casing or housing 12 (e.g., metallic enclosure) in which is disposed a core-winding assembly 14 formed of a magnetic core 16 with windings 18 there-around. According to an embodiment of the invention, magnetic core-winding assembly 14 includes a three phase magnetic core 16 having, for example, winding legs 20, 22, 24 connected by upper and lower yoke portions 26, 28, respectively. Magnetic core 16 can be formed of a plurality of stacks of magnetic, metallic laminations (not shown), such as grain-oriented silicon steel, for example. While transformer 10 is shown as including a three phase magnetic core 16, it is recognized that transformer 10 could also be configured as a single-phase transformer or a voltage regulator.

The windings 18 include winding assemblies 30, 32, 34, disposed about winding legs 20, 22, 24, respectively. Each of the phase winding assemblies 30, 32, 34 is composed of a set of primary and secondary windings, with the sets of primary and secondary windings being connected in any known type of multiphase configuration. The windings 18 are formed from strips of electrically conductive material such as copper or aluminum and can be rectangular or round in shape, for example, although other materials and shapes may also be suitable. Individual turns of windings 18 are electrically insulated from each other by cellulose insulating paper 36 (i.e., "Kraft paper") to ensure that current travels throughout every winding turn and to protect the windings 18 from the high electrical and physical stresses present in the transformer.

As shown in FIG. 3, transformer 10 is configured as a liquid-filled transformer in that the core 16 and windings 18 are immersed in a bath of transformer fluid 38 that both cools and electrically insulates the windings 18. That is, transformer fluid 38 is a dielectric fluid that also exhibits desirable cooling properties. According to an exemplary embodiment, the transformer fluid 38 is in the form of an oil-based fluid having a high fire point (i.e., a less-flammable fluid). The transformer fluid could be in form of a seed-, vegetable-, bio-, or natural ester-based oil or a silicone-based oil or synthetic hydrocarbon, that remains stable at transformer operating temperature conditions and provides superior heat transfer capabilities. It is also recognized, however, that other dielectric fluids could be utilized having suitable insulating and cooling properties, such as fluorinated hydrocarbons, for example, or any other dielectric fluid that exhibits desirable stability and heat transfer capabilities.

The housing 12 of transformer 10 is filled to a level 40 with the transformer fluid 38, with a nitrogen gas blanket 42 at the top of the internal volume of the transformer housing 12 used to maintain the dielectric quality of the fluid within the housing. In accordance with FIG. 3, a circulation flow path 44 is defined within the housing 12 according to which transformer fluid 38 is circulated across and through the windings 18 and within the housing 12. Transformer fluid 38 is circulated within housing 12, in part, according to natural convection flow, which relies on changes in fluid density to naturally create circulation flow. That is, during operation of transformer 10 the transformer fluid 38 about core 16 and windings 18 heats up, thereby forcing it to rise upward, as indicated by arrows 44. Once the transformer fluid 38 exits flow channels defined by windings 18, the heated fluid rises toward the top of the fluid level in housing 12. Subsequent cooling of the heated transformer fluid 38 in an upper portion of housing 12 by a cooling system 50, as explained in detail below, then causes cooled dielectric fluid to sink toward a lower portion of housing 12 by natural convection, again indicated by arrows 44, thereby allowing for re-circulation of cooled fluid across and through windings 18 and core 16 to repeat the process. Thus, natural convection flow circulates transformer fluid 38 generally along circulation flow path 44, although it is recognized that the natural convection flow may be somewhat less definitive in certain locations.

According to one embodiment of the invention, circulation flow path 44 is further defined by forced convection flow. That is, transformer 10 includes pumps, impellers, or propellers 46 within housing 12 to push and direct the transformer fluid 38 through the core-winding assembly 14 according to a forced convection flow. During operation, pumps 46 force transformer fluid 38 from a base of the transformer 10 upward, as indicated by arrows 44, over and through the various openings provided within the internal workings of the transformer and in and about core 16 and windings 18. The windings 18 preferably are wound with key spacers (not shown) that direct the flow of transformer fluid 38 through the windings 18 in a pattern that maximizes the flow of fluid across the windings 18 so as to maximize cooling of windings 18. The temperature of the transformer fluid 38 increases as it draws off heat, and thereby cools the transformer parts which have increased in temperature due to their operation (i.e., the windings 18 and core 16).

Referring still to FIG. 3, transformer 10 further includes a cooling system 50 provided to reduce the temperature of the transformer fluid 38 contained within housing 12. That is, cooling system 50 is provided to maintain the temperature of the transformer fluid 38 below a desired level, such that temperature within housing 12 is maintained at a level that can be tolerated by insulation 36 on windings 18. Typically, maximum temperatures within the transformer 10 are designed to be maintained below 95° Celsius or limited to a 65° Celsius rise above ambient temperatures in order to maintain rated capability of the transformer and preserve useful life. Cooling system 50 is thus configured to selectively provide cooling to transformer fluid 38 to maintain the fluid below such maximum temperatures.

According to an exemplary embodiment of the invention, cooling system 50 is formed as a closed-loop cooling system having a cooling fluid 52 flowing there through that is separate from the transformer fluid 38 contained in transformer housing 12. That is, cooling system 50 includes a quantity of cooling fluid 52 therein that is circulated through the cooling system 50 separate from transformer fluid 38 contained in transformer housing 12, such that no mixing between the cooling fluid 52 and the transformer fluid 38 occurs. As cooling system 50 is formed as a closed-loop cooling system having a cooling fluid 52 flowing there through that is separate from the transformer fluid 38, cooling system 50 is operable in a pressurized state. That is, the cooling fluid 52 in cooling system 50 is maintained at a higher pressure level as compared to transformer fluid 38 in housing 12. For example, cooling fluid 52 can be maintained at greater than five pounds of pressure (e.g., 10 lbs) as compared to the transformer fluid 38 being maintained at less than five pounds of pressure.

As shown in FIG. 3, cooling system 50 includes a closed-loop cooling path or conduit 54 housing the quantity of cooling fluid 52, as well as one or more pumps 56 and/or valves 58 for controlling circulation of the cooling fluid 52 through the cooling path 54. The cooling fluid 52 may be any dielectric fluid that remains stable at transformer operating temperature conditions and provides superior heat transfer capabilities, such as a seed-, vegetable-, bio-, or natural ester-based oil, or a stable silicone-based oil or synthetic hydrocarbon, for example. According to an exemplary embodiment, cooling system 50 is designed such that the dielectric cooling fluid 52 provided therein is identical to dielectric transformer fluid 38 contained within housing 12. Thus, if the transformer fluid 38 contained within housing 12 is a less-flammable seed-based oil, for example, then the cooling fluid 52 contained within cooling system 50 is an identical seed-based oil. Beneficially, use of identical fluids for the dielectric and cooling fluids 38, 52 provides a safeguard for transformer 10, as in the event of a leak in the cooling system 50, as no contamination of the oil-based transformer fluid 38 in housing 12 of the transformer will occur should the cooling fluid 52 leak into the transformer fluid 38. It is also recognized, however, that cooling fluid 52 could be a dielectric fluid that is different from the dielectric fluid of transformer fluid 38.

Cooling system 50 also includes one or more internal liquid-to-liquid heat exchanger(s) 60 configured to cool the transformer fluid 38 in housing 12. That is, heat exchanger(s) 60 are located along the cooling path 54 so as to be positioned within housing 12 of transformer 10 and immersed in the bath of transformer fluid 38, and thus are configured as fluid-to-fluid heat exchangers. According to an exemplary embodiment, cooling path 54 enters transformer 10 through a top panel 62 of housing 12 to connect to heat exchanger 60, such that the possibility of leakage of dielectric fluid from housing 12 is eliminated. The immersion of heat exchanger(s) 60 within transformer fluid 38 provides for a fluid-to-fluid transfer of heat energy between flows of working fluids, those being the cooling fluid 52 of closed-loop cooling system 50 and the transformer fluid 38 contained within housing 12. Heat exchanger(s) 60 can be any one of a variety of differently configured heat exchangers that rely upon a fluid-to-fluid transfer of heat energy between flows of working fluids, such as cold-plate, chiller, or oil cooler heat exchangers, for example.

According to an embodiment of the invention, heat exchanger(s) 60 are positioned within housing 12 in an area above core-winding assembly 14 so as to be immersed within the bath of transformer fluid 38. As heat is extracted from the transformer fluid 38 surrounding heat exchanger(s) 60, the cooled transformer fluid 38 can be circulated within housing 12 by natural convection and by forced convection flow. According to the embodiment of FIG. 3, impellers/propellers 46 within housing 12 can push and direct the transformer fluid 38 through the core-winding assembly 14 according to a directed forced convection flow (along circulation flow path 44).

Figure 4:
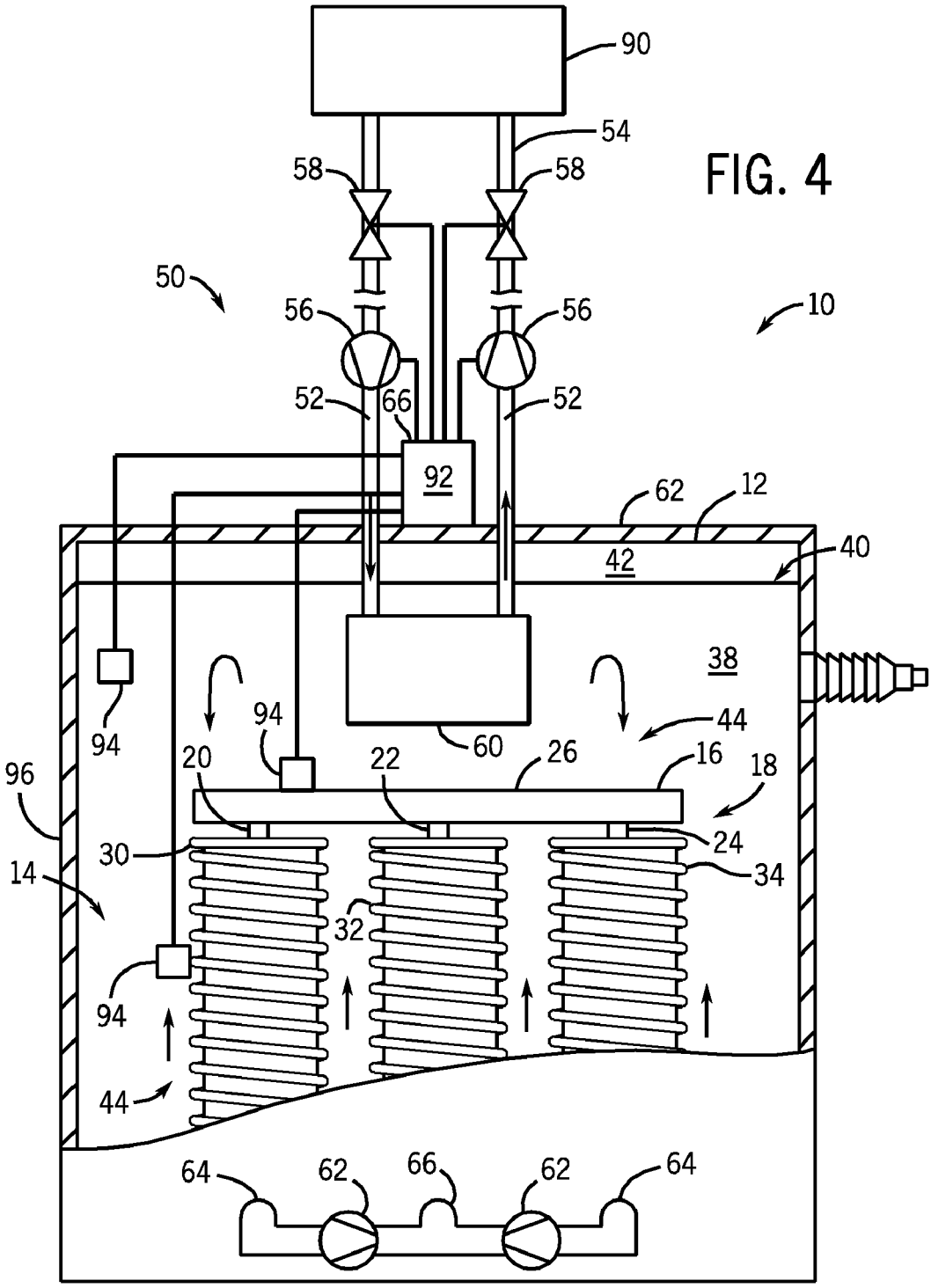
FIG. 4 is a schematic view of a liquid-filled transformer and associated cooling system according to another embodiment of the invention.

According to another embodiment, and as shown in FIG. 4, one or more oil circulating pumps 62 can be mounted on lower exterior flanges 64 of housing 12 to pump cooled transformer fluid 38 through the core-winding assembly 14. That is, assuming that the oil in the bottom corners of the housing 12 will be the coolest based on the locations of the heat exchanger(s) 60, oil circulating pumps 62 function to pump this 'cool' oil into a center flange 66 with an interior of the center flange having a manifold or piping to direct the oil into and through each of the windings 18 of core-winding assembly 14.

Figure 5:
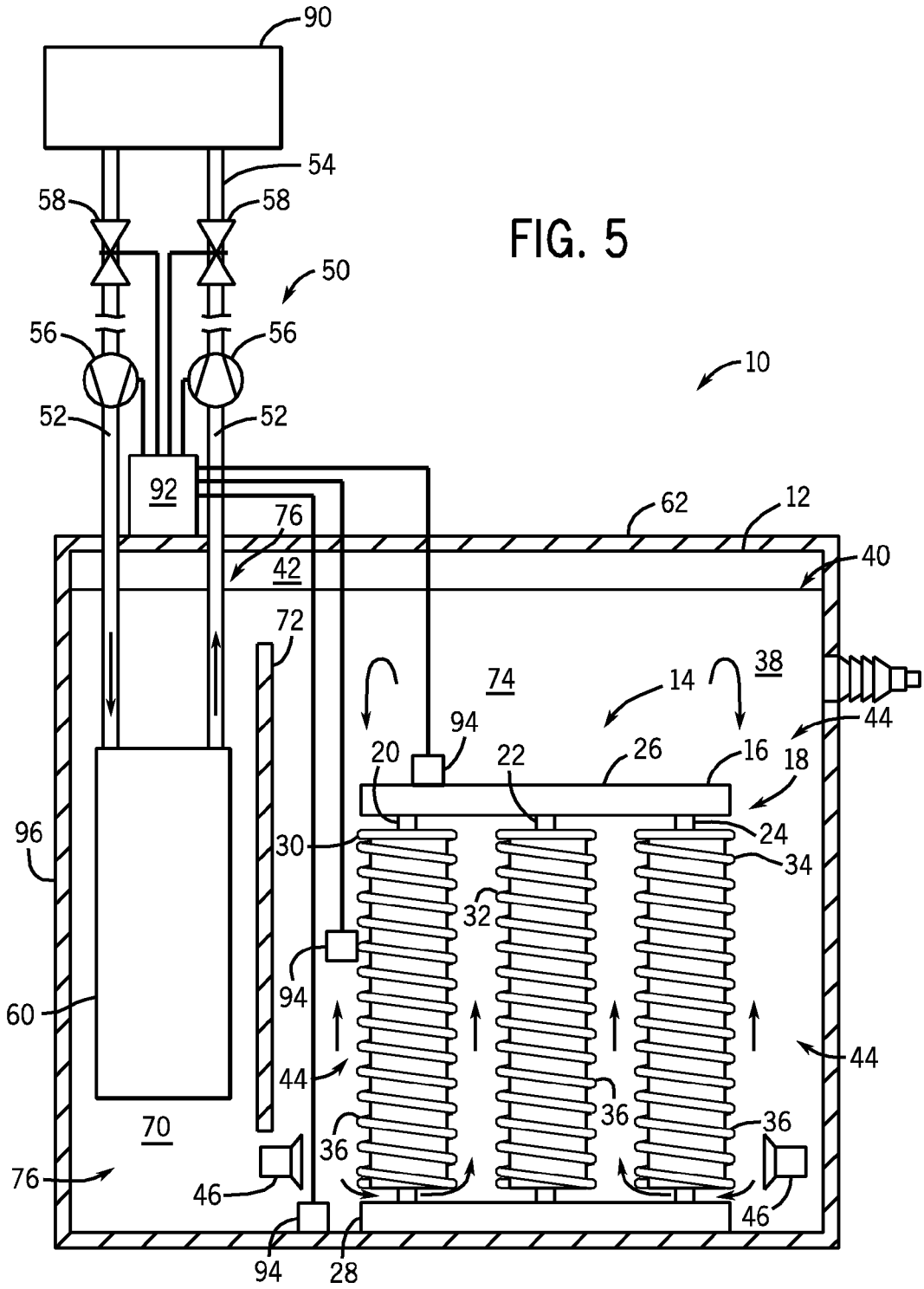
FIG. 5 is a schematic view of a liquid-filled transformer and associated cooling system according to another embodiment of the invention.

According to additional embodiments of the invention, heat exchanger(s) 60 are positioned so as to be substantially separated from a main chamber of housing 12 in which core-winding assembly 14 is positioned. As shown in FIG. 5, according to one embodiment of the invention, heat exchanger(s) 60 are positioned in a side chamber 70 of housing 12, with a baffle 72 being provided to separate side chamber 70 from a main chamber 74 housing core-winding assembly 14. While chamber 70 is described as a "side chamber" and is shown as being oriented perpendicularly to core-winding assembly 14, it is recognized that chamber 70 (and heat exchanger(s) 60 positioned therein) could also be formed as a chamber running parallel to the core-winding assembly 14 along the front or back of housing 12. As such, the general referencing of "side" chamber 70 is meant to encompass other locations and orientations of chamber 70 not shown in FIG. 5. Referring again to FIG. 5, channels 76 are formed above and below baffle 72 to provide for a flow of transformer fluid 38 between main chamber 74 and side chamber 70. As heat is extracted from the transformer fluid 38 surrounding heat exchanger(s) 60, the baffle 72 functions to cause natural convection that circulates hot transformer fluid 38 out from main chamber 74 and into side chamber 70 where heat exchanger(s) 60 are positioned, thereby also causing a flow of cooled transformer fluid 38 out of the side chamber 70 into main chamber 74, such that cooled transformer fluid 38 is provided for circulation through each of the windings 18 of core-winding assembly 14.

Figure 6:
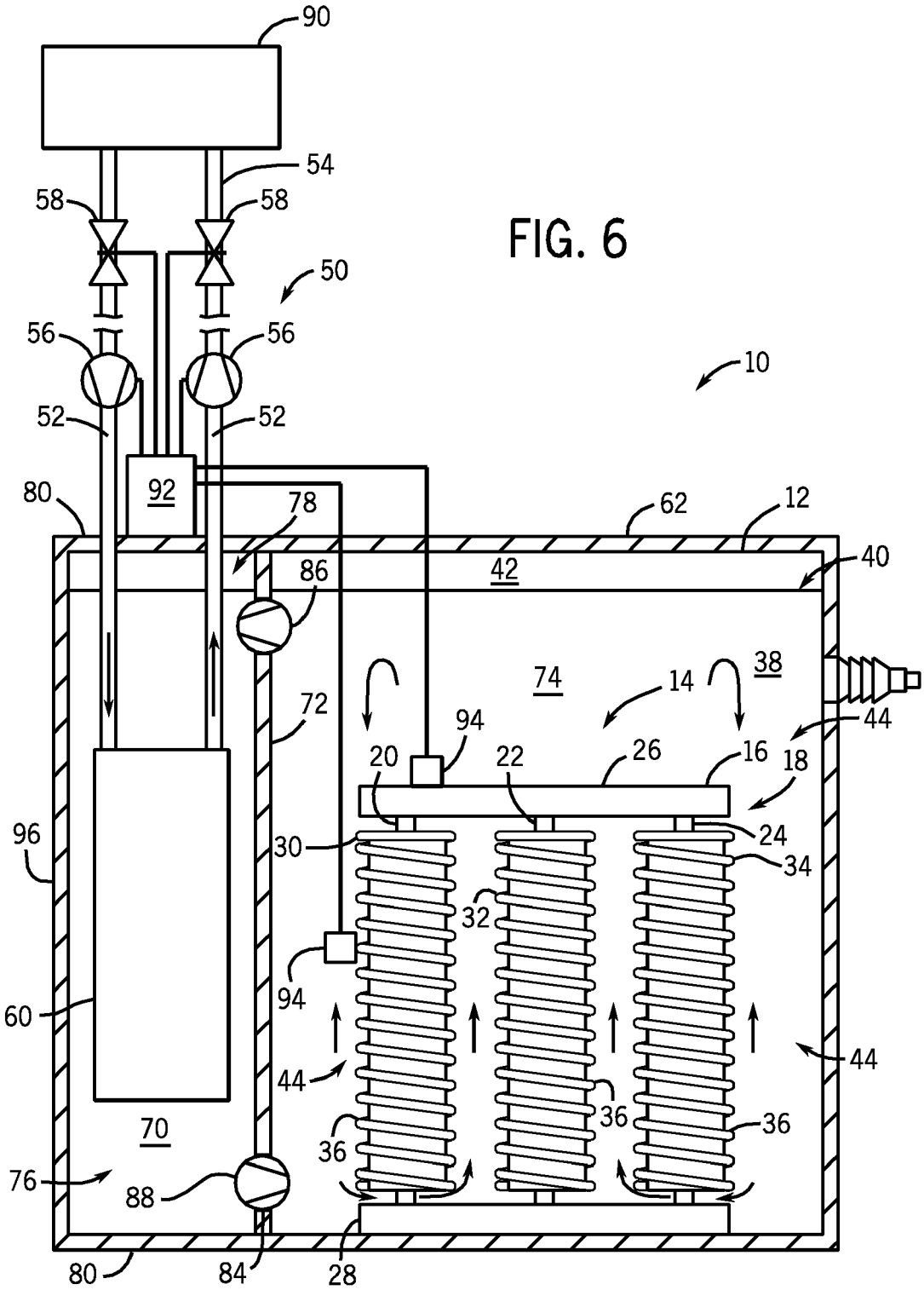
FIG. 6 is a schematic view of a liquid-filled transformer and associated cooling system according to another embodiment of the invention.

According to another embodiment of the invention, and as shown in FIG. 6, heat exchanger(s) 60 are positioned in a self-enclosed tank 78 separated from housing 12. Tank 78 is mounted on upper and lower exterior flanges 80 of housing 12 and is fluidly connected to housing 12 by way of conduits 82, 84, such that dielectric fluid is allowed to flow between tank 78 and housing 12 by flow channels formed by the conduits 82, 84. Tank 78 may be "pump mounted" to housing 12 in that pumps 86, 88 are positioned between tank 78 and housing 12 to provide forced convection flow of transformer fluid 38 (i.e., forced-oil cooling). Pump 86 functions to force heated transformer fluid 38 surrounding core-winding assembly 14 through conduit 82 and into tank 78, where heat exchanger(s) 60, cool the transformer fluid 38. Upon cooling, pump 88 functions to force cooled transformer fluid 38 out from tank 78, through conduit 84, and back into housing 12 such that cooled transformer fluid 38 is provided for circulation through each of the windings 18 of core-winding assembly 14.

It is noted that while tank 78 is described as being separate from housing 12, tank 78 is a thin-profiled tank (e.g., 12 inches deep). As the space requirements for tank 78 are thus minimal, for purposes of describing the invention, tank 78 can be described as generally forming part of an overall "housing" of the transformer 10, with tank 78 being a "side chamber/side tank" separated from a "main chamber/main tank" that is housing 12, similar to the embodiment of transformer 10 shown and described with respect to FIG. 5. Furthermore, while tank 78 is shown in FIG. 6 as being located along a side of housing 12 and oriented perpendicularly to core-winding assembly 14, it is recognized that tank 78 could also be positioned adjacent/along a front or back surface of housing 12, such that tank 78 (and heat exchanger(s) 60 positioned therein) runs parallel to the core-winding assembly 14. As such, the illustration in FIG. 6 of the positioning of tank 78 is not meant to be limiting, and other orientations and positions of tank 78 are understood as being within the scope of the invention.

Referring again to FIG. 3, cooling system 50 also includes a heat dissipation system 90 that is positioned on cooling path 54 at a location remote from heat exchanger(s) 60. For example, for a heat exchanger 60 housed within housing 12 of a transformer 10 located in the interior of a building, heat dissipation system 90 will be mounted at an external location outside of the building, such as on the roof, or in an underground vault, or in a courtyard/other protected area. According to an embodiment of the invention, heat dissipation system 90 is configured as a liquid-to-air heat exchanger that provides for cooling of the cooling fluid 52 circulating through cooling path 54, such as a radiator-type heat exchanger for example. Alternatively heat dissipation system 90 could be any number of other types of heat exchange system the employ air, water, ice, or any other cooling medium.

Heat dissipation system 90 is positioned on cooling path 54 downstream from heat exchanger(s) 60 so as to receive cooling fluid 52 that is at an elevated temperature based on the heat energy transferred thereto from the higher temperature transformer fluid 38. According to one embodiment of the invention, the external heat dissipation system 90 acts to cool the cooling fluid 52 based on a fluid-to-air transfer of heat energy. Based on positioning of heat dissipation system 90 at a remote/external location, cooling system 50 thus functions to remove the heat generated by the transformer 10 from a surrounding environment, such as the interior of a building.

Alternatively, it is recognized that the external heat dissipation system 90 could cool the cooling fluid 52 based on a transfer of thermal energy from cooling fluid to water, ice, or any other suitable medium/substance that is readily available. It is also recognized that the heat generated by the transformer 10 that is removed by heat dissipation system 90 can be captured for use in some other heating need or process or manufacturing operations, for example.

Also preferably included in cooling system 50 is a temperature sensing and control mechanism or system 92 that functions to optimize the heat transfer in the cooling system 50. Preferably, the control system 92 can be a conventional programmable controller that generates control signals as a function of various input signals. According to an exemplary embodiment, the control system 92 can be programmed to control functioning of pumps 56 and valves 58 as a function of the temperature of the transformer fluid 38. Control system 92 can receive input signals from temperature sensors 94 installed internally to the transformer housing 12, such as suspended in transformer fluid 38 in the top third of the housing 12 in particular, to measure the temperature of the transformer fluid 38. Alternatively, or in addition thereto, temperature sensors 94 could also be positioned on core 16 and/or windings 18 and toward the bottom of housing 12 to measure the temperature of the core 16, windings 18, and/or transformer fluid 38 in the bottom of the housing 12.

According to embodiments of the invention, control system 92 can be configured to employ a temperature threshold feature or employ a "look ahead" feature for purposes of controlling cooling system 50. When employing a temperature threshold feature, control system 92 can receive input signals from temperature sensors 94 regarding a sensed temperature of the transformer fluid 38, core 16, and/or windings 18. The sensed temperature of the transformer fluid 38, core 16, and/or windings 18 is compared to a pre-determined threshold temperature stored in a memory of the control system 92. If the sensed temperature of the transformer fluid 38 exceeds the threshold temperature, control system 92 then automatically engages or steps up the cooling system 50 by activating and/or modifying operation of pump(s) 56 and valve(s) 58 so as to circulate cooling fluid 52 through heat exchanger 60 and heat dissipation system 90 at a desired rate, thereby initiating and/or modifying cooling of transformer fluid 38. According to one embodiment of the invention, the cooling system 50 may have, for example, high-medium-low cooling settings and, based on sensed inputs, could be activated and controlled in any combination of steps.

When employing a "look ahead" feature, control system 92 can receive input signals from temperature sensors 94 regarding a sensed temperature of the transformer fluid 38, core 16, and/or windings 18. The temperature is monitored such that, as the sensed temperature of the transformer fluid 38, core 16, and/or windings 18 begins to rise, input signals from the sensors 94 are extrapolated by control system 92 to determine if the maximum temperature will exceed an acceptable level during a pre-determined ensuing time period. If the maximum temperature is anticipated to be exceeded, then controller 66 automatically engages cooling system 50 by activating pump(s) 56 and valve(s) 58 so as to circulate cooling fluid 52 through heat exchanger(s) 60 and heat dissipation system 90 to initiate cooling of dielectric fluid. It is also recognized that engaging/modification of cooling system 50 can be initiated through logic interpreting signals from other 'traditional' sensors, or external remote or supervisory control inputs other than temperature sensors 94. Due to this "look ahead" feature, the temperature of internal components (i.e., core 16 and windings 18) of transformer 10 is controlled such that the temperature does not approach temperatures which could reduce the useful life or efficiency of the transformer 10.

While transformer 10 shown in FIG. 3 is described as including a single cooling system 50 having a single liquid-to-liquid heat exchanger 60 enclosed within housing 12, it is recognized that multiple cooling systems 50 could be implemented for use in transformer 10, that cooling system 50 could implement multiple heat exchangers 60 therein, or that cooling system 50 could be oversized to the base need of the transformer, so as to provide additional cooling and allow the transformer 10 to run at higher than original design ratings (i.e., extend the rating). According to one embodiment of the invention, a plurality of closed-loop cooling systems 50, each including a liquid-to-liquid heat exchanger 60 immersed within transformer fluid 38 in housing 12, could be implemented in a single transformer 10 to increase the amount of heat energy that could be extracted from transformer fluid 38. According to another embodiment of the invention, a single cooling system 50 could include multiple heat exchanger(s) 60 immersed within transformer fluid 38 in housing 12 and positioned along cooling path 54. Implementing of multiple heat exchangers 60 in cooling system 50 would also provide some redundancy in the system so as to improve up time.

Referring again to FIG. 3, the housing 12 of transformer 10 is shown as including an insulating layer 96 affixed thereto, according to an embodiment of the invention. Insulating layer 96 is constructed to provide improved containment of heat generated by transformer 10 within housing 12, such that a greater amount of heat is transferred to cooling system 50 rather than escaping to the environment surrounding transformer 10. Insulating layer 96 is further constructed to provide improved containment of noise generated by transformer 10. Beneficially, insulating layer 96 thus helps to minimize audible noise generated by transformer 10, thereby allowing for placement of transformer 10 within the interior of a building.

Figure 7:
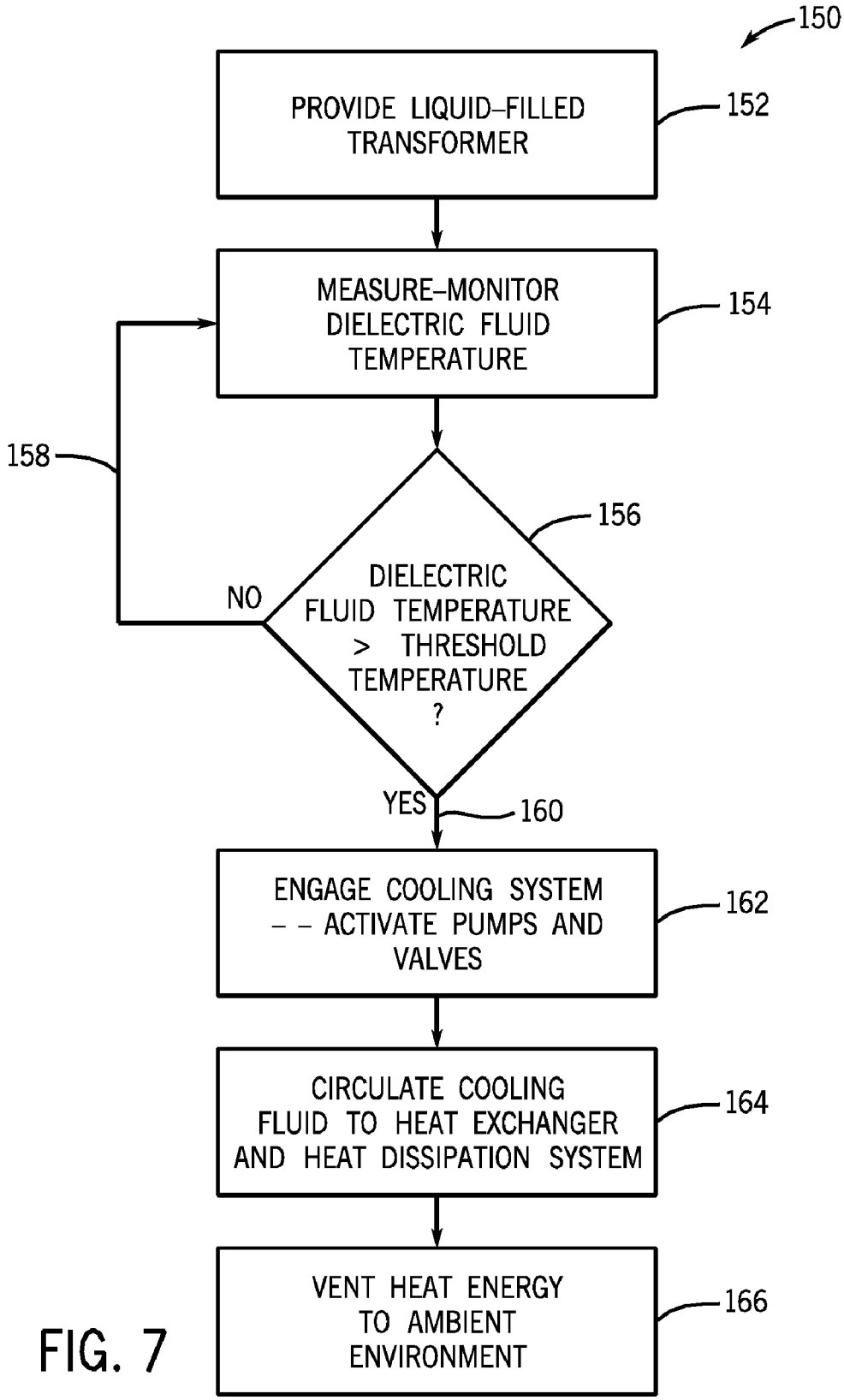
FIG. 7 is a flow chart illustrating a technique for cooling a transformer according to an embodiment of the invention.

Referring now to FIG. 7, and with continued reference to FIG. 3, a method 150 for providing cooling to transformer 10 is set forth. The method 150 begins at STEP 152 with providing of a liquid-filled transformer 10 having a housing 12 filled with a transformer fluid 38 that immerses a core-winding assembly 14 housed therein. A transformer cooling system 50 is provided as part of transformer 10 that functions to provide cooling to the transformer fluid 38. Included in the cooling system 50 is a cooling fluid 52, a closed-loop cooling conduit 54 that maintains/circulates the cooling fluid 52 separately from the transformer fluid 38 contained in the transformer housing, one or more pumps 56 and valves 58, a fluid-to-fluid heat exchanger 60, a heat dissipation system 90, and a control system 92 and temperature sensors 94.

According to the method 150, selective operation of cooling system 50 includes a monitoring or measuring of a temperature of transformer fluid 38, core 16, and/or windings 18 by way of control system 92 and temperature sensors 94 at STEP 154. Temperature of transformer fluid 38, core 16, and/or windings 18 is measured by sensors 94, and the measurements are received by control system 92 as input. A determination is made by control system 92 at STEP 156 as to whether the sensed temperature exceeds a pre-determined threshold temperature. If the sensed temperature does not exceed the pre-determined threshold temperature, indicated at 158, then the method 150 proceeds by looping back to STEP 154, where additional monitoring or measuring of the temperature of transformer fluid 38, core 16, and/or windings 18 is performed by control system 92 and temperature sensors 94. However, if it is determined that the sensed temperature does exceed the pre-determined threshold temperature, indicated at 160, then method 150 continues by initiating (or modifying) cooling of the dielectric fluid. That is, as shown in FIG. 7, method 150 then continues at STEP 162, where control system 92 automatically engages cooling system 50 by activating pump(s) 56 and valve(s) 58 and/or modifying operation thereof between low-medium-high settings.

Circulation of cooling fluid 52 through heat exchanger 60 and heat dissipation system 90 is thus initiated or modified at STEP 164, thereby providing cooling of transformer fluid 38. In operation of cooling system 50, the heat exchanger 60 removes heat energy from transformer fluid 38 based on the fluid-to-fluid transfer of heat energy between the flow of cooling fluid 52 passing through the heat exchanger 60 and the transformer fluid 38 in which the heat exchanger 60 is immersed. As the cooling fluid 52 is maintained at a lower temperature than dielectric fluid, heat energy is transferred from the dielectric fluid to the cooling fluid 52. While STEP 156 is described above is determining whether the sensed temperature of the transformer fluid 38, core 16, and/or windings 18 exceeds a pre-determined threshold temperature, it is recognized that STEP 156 could instead determine whether a rate-of-rise of temperature and/or any other input from traditional local sensing (as well as local and remote supervisory control) falls outside pre-determined limits, for purposes of initiating/modifying cooling provided by cooling system 50. Such a control scheme may provide for both better efficiency as well as cost savings, as compared to a simple temperature threshold analysis.

Having passed through heat exchanger(s) 60, the warmed cooling fluid 52 continues downstream through cooling path 54 to heat dissipation system 90, which according to an exemplary embodiment of the invention, is located remotely from heat exchanger 60 and preferably at an external location (i.e., on the exterior of a building). At STEP 166, heat dissipation system 90 acts to remove heat energy transferred to the cooling fluid 52 from the transformer fluid 38, such as by venting heat to an ambient environment at a location remote from the transformer housing or by extracting heat energy from cooling fluid 52 and storing this heat energy for future use (e.g., converting heat energy to mechanical/electrical power). According to one embodiment of the invention, heat dissipation system 90 is configured as a liquid-to-air heat exchanger, such as a radiator-type heat exchanger for example. Heat dissipation system 90 thus acts to cool the cooling fluid 52 based on a fluid-to-air transfer of heat energy between the cooling fluid 52 and the ambient environment.

Figure 8:
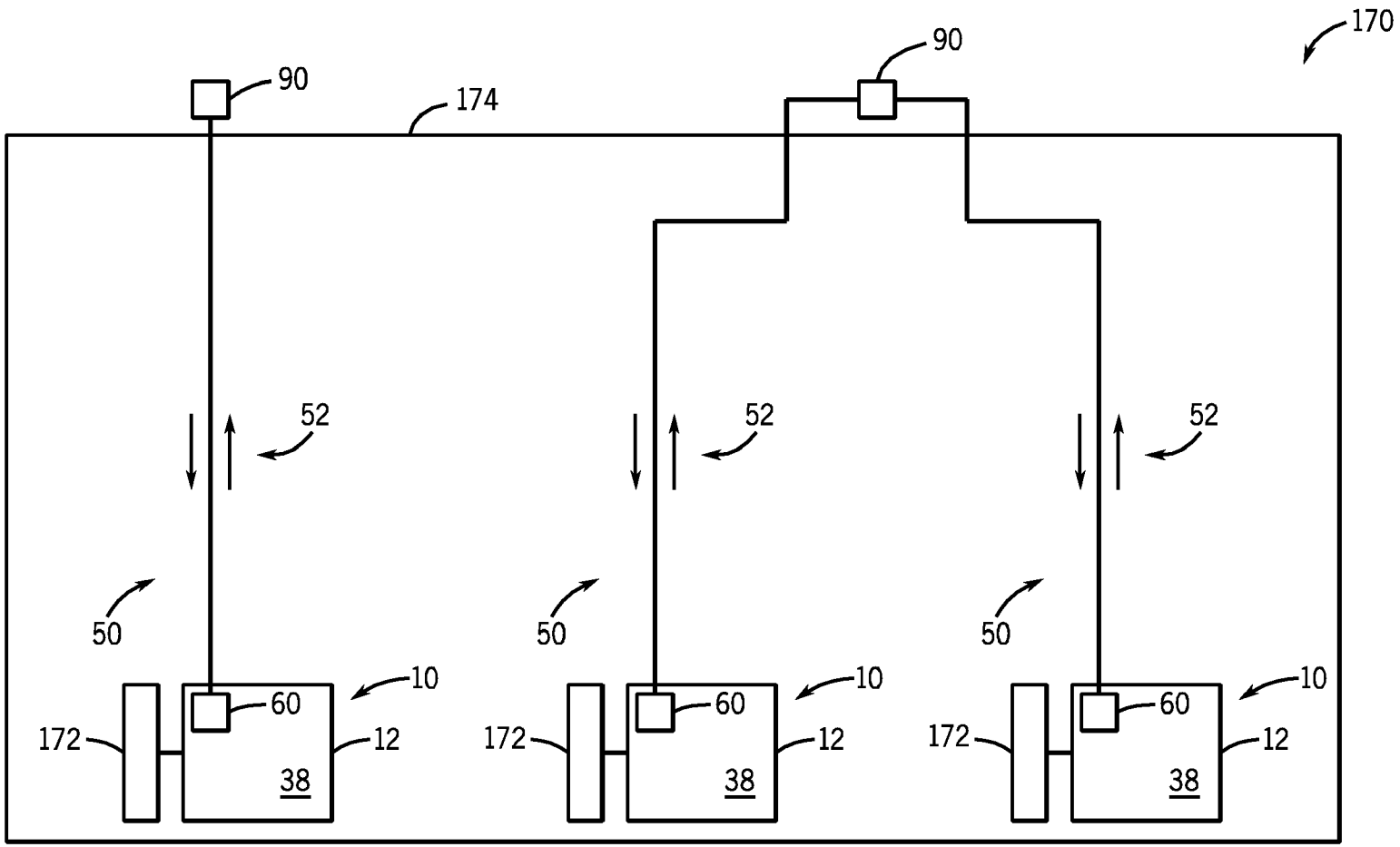
FIG. 8 is a schematic diagram illustrating positioning of a liquid-filled transformer and associated cooling system within a building according to an embodiment of the invention.

Referring now to FIG. 8, positioning of a plurality of transformers 10 within the interior of a building 170 is illustrated. As set forth above, transformers 10 are liquid-filled transformers that include a less-flammable, oil-based fluid (i.e., transformer fluid 38) within housing 12 that remains stable at transformer operating temperature conditions and provides superior heat transfer capabilities, thus allowing for placement of transformers 10 within building 170 and adjacent to a load 172. The cooling system 50 included in each of the transformers 10 is configured as a closed-loop cooling system that circulates a quantity of cooling fluid 52 from the liquid-to-liquid heat exchanger(s) 60 positioned within housing 12 out to heat dissipation system 90. As shown in FIG. 8, according to an exemplary embodiment of the invention, heat dissipation system 90 is positioned on a roof 174 of building 170 remote from heat exchanger 60, although it is also recognized that the heat dissipation system 90 could also be positioned in a courtyard or a vault or other protected areas outside of building 170. As heat dissipation system 90 is positioned on roof 174 of building 170, heat energy extracted from cooling fluid 52 by the heat dissipation system 90 can be vented to the outside/ambient environment, thereby allowing heat generated by transformer 10 to be efficiently removed from building 170.

According to an embodiment of the invention, a dedicated heat dissipation system 90 is provided for each of the transformers 10 and its associated cooling system 50. According to another embodiment of the invention, more than one transformer 10 is connected to a single external heat dissipation system 90. A single heat dissipation system 90 is thus shared by a plurality of cooling systems 50, such that fluid is pumped to the heat dissipation system 90 from multiple closed-loop cooling paths 54.

The transformer 10 implementing cooling system 50 in accordance with the embodiments of the present invention set forth above provides numerous advantages. For example, using a compatible cooling fluid 52 in the internal heat exchanger 60 avoids contamination or reduction of dielectric strength of the transformer fluid 38 if a leak were to occur in cooling system 50, such that cooling fluid 52 leaks into transformer fluid 38. Additionally, the replacement of any cooling mechanisms located externally of housing 12 (e.g., radiators) with a cooling system 50 having a liquid-to-liquid heat exchanger 60 positioned internally of housing 12 provides for a transformer 10 having a reduced size so as to improve and optimizes indoor deployment with both shorter secondaries, smaller footprint, and less emitted heat. Moving transformer equipment from outside of the building to inside of the building, where access is controlled, also eliminates exposure to damage from the environment and vandals, terrorists, etc. Furthermore, transformers 10 in accordance with embodiments of the present invention set forth above lead to a comparable first cost (purchase and installation of equipment) to commercially available transformers, but operate at a much lower annual cost due to lower losses and energy costs associated therewith.

According to embodiments of the present invention, it is recognized that cooling system 50 can be implemented as part of a retrofitting kit that can be added to existing transformers. For example, with respect to the embodiment of cooling system 50 shown and described in FIG. 4, heat exchanger(s) 60 can be added within a housing of an existing transformer and oil circulating pumps 62 can be mounted on lower exterior flanges of the housing to pump cooled dielectric fluid through a manifold or piping mounted on lower exterior flanges to the core-winding assembly. The heat exchanger(s) 60 are connected via a closed loop cooling path 54 to a remote heat dissipation system 90 for removing heat from the transformer and the surrounding environment. Beneficially, retrofitting an existing transformer with cooling system 50 allows for removal of any externally mounted radiators from the transformer, thereby reducing the transformer footprint and providing for transfer of heat generated by the transformer to a remote location.

It is also recognized that embodiments of the invention are not to be limited to the specific transformer configurations set forth in detail above. That is, all single-phase and three-phase transformers and voltage regulators are recognized to fall within the scope of the invention. Additionally, it is recognized that medium power transformers as well as large power, substation, generator step-up, auxiliary, auto, grounding, and furnace transformers (all with or without load-tap changers) are within the scope of the invention.

Therefore, according to an embodiment of the invention, a transformer includes a housing, a core-winding assembly positioned within the housing that includes a transformer core and a plurality of windings wound about the transformer core, a transformer fluid contained within the housing and immersing the core-winding assembly, and a cooling system configured to cool the transformer fluid contained within the housing. The cooling system includes a closed-loop fluid path having a quantity of cooling fluid that is circulated there through and a liquid-to-liquid heat exchanger positioned along the closed-loop fluid path and within the housing so as to be immersed within the transformer fluid, with the liquid-to-liquid heat exchanger configured to cool the transformer fluid contained within the housing based on a liquid-to-liquid transfer of heat energy between the cooling fluid and the transformer fluid. The cooling system also includes a heat dissipation system positioned remotely from the liquid-to-liquid heat exchanger and configured to cool the cooling fluid circulating through the closed-loop fluid path. The cooling fluid comprises a first dielectric fluid and the transformer fluid comprises a second dielectric fluid, with the first dielectric fluid being maintained separate from the second dielectric fluid.

According to another embodiment of the invention, a transformer includes a transformer housing defining a main chamber and a side chamber, a core-winding assembly positioned within the main chamber of the transformer housing and having a transformer core and a plurality of windings wound about the transformer core, and a dielectric transformer fluid substantially filling the main chamber and the side chamber of the transformer housing such that the core-winding assembly is immersed in the dielectric transformer fluid. That transformer also includes a transformer cooling system configured to cool the dielectric transformer fluid contained within the main chamber and the side chamber of the transformer housing, with the transformer cooling system further including a closed-loop fluid path and a quantity of dielectric cooling fluid contained within the closed-loop fluid path that is circulated there through so as to be maintained separately from the dielectric transformer fluid. The transformer cooling system also includes a liquid-to-liquid heat exchanger included on the closed-loop fluid path and positioned within the side chamber of the transformer housing so as to be immersed within the dielectric transformer fluid and a heat dissipation system positioned remotely from the liquid-to-liquid heat exchanger and configured to cool the dielectric cooling fluid circulating through the closed-loop fluid path. The transformer cooling system is configured to selectively circulate a dielectric cooling fluid through the liquid-to-liquid heat exchanger to extract heat energy from the dielectric transformer fluid based on a liquid-to-liquid transfer of heat energy between the dielectric cooling fluid and the dielectric transformer liquid.

According to yet another embodiment of the invention, a cooling system for providing cooling to a liquid-filled transformer includes a closed-loop fluid path, a quantity of cooling fluid contained within the closed-loop fluid path that is circulated through the closed-loop fluid path, and a liquid-to-liquid heat exchanger included in the closed-loop fluid path and being positioned within a housing of the liquid-filled transformer so as to be immersed in a transformer fluid contained within the housing, with the liquid-to-liquid heat exchanger configured to cool the transformer fluid based on a liquid-to-liquid transfer of heat energy between the cooling fluid and the transformer fluid. The cooling system also includes a heat dissipation system configured to cool the cooling fluid circulating through the closed-loop fluid path, with the heat dissipation system being positioned along the closed-loop fluid path remotely from the liquid-to-liquid heat exchanger. The cooling fluid is in the form of a first dielectric fluid and the transformer fluid is in the form of a second dielectric fluid.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A transformer comprising:

a housing;

a core-winding assembly positioned within the housing and including a transformer core and a plurality of windings wound about the transformer core;

a transformer fluid contained within the housing and immersing the core-winding assembly; and a cooling system configured to cool the transformer fluid contained within the housing, the cooling system comprising:

a closed-loop fluid path;

a quantity of cooling fluid contained within the closed-loop fluid path that is circulated there through;

a liquid-to-liquid heat exchanger positioned along the closed-loop fluid path and within the housing so as to be immersed within the transformer fluid, the liquid-to-liquid heat exchanger configured to cool the transformer fluid contained within the housing based on a liquid-to-liquid transfer of heat energy between the cooling fluid and the transformer fluid; and a heat dissipation system positioned remotely from the liquid-to-liquid heat exchanger and configured to cool the cooling fluid circulating through the closed-loop fluid path;

wherein the cooling fluid comprises a first dielectric fluid and the transformer fluid comprises a second dielectric fluid, the first dielectric fluid being maintained separate from the second dielectric fluid.

2. The transformer of claim 1 wherein the housing comprises:

a main chamber having the core-winding assembly positioned therein;

a side chamber having the liquid-to-liquid heat exchanger positioned therein; and a baffle separating the main chamber from the side chamber, the baffle being constructed such that a pair of channels is formed between the main chamber and the side chamber to provide fluid flow of transformer fluid between the main chamber and the side chamber.

3. The transformer of claim 1 wherein the housing comprises:

a main housing having the core-winding assembly positioned therein; and a side-tank mounted to the main housing and configured to house the liquid-to-liquid heat exchanger therein.

4. The transformer of claim 3 further comprising pumps positioned between the side-tank and the main housing to provide forced convection flow of transformer fluid between the side-tank and the main housing, wherein the tank is pump-mounted to the housing.

5. The transformer of claim 1 wherein the housing comprises a plurality of external lower flanges including outer lower flanges and at least one inner lower flange, and wherein the transformer further comprises:

at least one circulating pump positioned external to the housing and mounted on the outer lower flanges; and a manifold positioned external to the housing and mounted on one of the at least one inner lower flanges, the manifold being fluidly connected to the at least one circulating pump;

wherein the at least one circulating pump is configured to pump cooled transformer fluid from the outer region of the housing and to the manifold for circulation through the core-winding assembly.

6. The transformer of claim 1 further comprising at least one of an impeller or a propeller positioned within the housing and immersed within the transformer fluid to cause a flow of the transformer fluid through the core-winding assembly.

7. The transformer of claim 1 further comprising an insulating layer positioned on the housing, the insulating layer configured to contain heat generated by the core-winding assembly within the housing and reduce audible noise generated by the transformer.

8. The transformer of claim 1 wherein the heat dissipation system is configured to capture heat energy extracted from the transformer fluid for use in one of a heating application and a manufacturing process, so as to provide for energy recapture in the transformer resulting in energy conservation as compared to an air-cooled transformer.

9. The transformer of claim 1 wherein the cooling system is configured to maintain the quantity of cooling fluid contained within the closed-loop fluid path at a higher pressure than the transformer fluid contained within the housing.

10. The transformer of claim 1 wherein the first dielectric fluid is a fluid identical to the second dielectric fluid, and wherein each of the first dielectric fluid and the second dielectric fluid comprises a high fire point dielectric fluid.

11. The transformer of claim 1 comprising at least one additional liquid-to-liquid heat exchanger positioned along the closed-loop fluid path and within the housing so as to be immersed within the transformer fluid, thereby forming a cooling system having a redundant heat exchanger arrangement.

12. A transformer comprising:

a transformer housing defining a main chamber and a side chamber;

a core-winding assembly positioned within the main chamber of the transformer housing, the core-winding assembly including a transformer core and a plurality of windings wound about the transformer core;

a dielectric transformer fluid substantially filling the main chamber and the side chamber of the transformer housing such that the core-winding assembly is immersed in the dielectric transformer fluid; and a transformer cooling system configured to cool the dielectric transformer fluid contained within the main chamber and the side chamber of the transformer housing, the transformer cooling system comprising:

a closed-loop fluid path;

a quantity of dielectric cooling fluid contained within the closed-loop fluid path that is circulated there through, the quantity of dielectric cooling fluid being maintained separately from the dielectric transformer fluid;

a liquid-to-liquid heat exchanger included on the closed-loop fluid path and positioned within the side chamber of the transformer housing so as to be immersed within the dielectric transformer fluid; and a heat dissipation system positioned remotely from the liquid-to-liquid heat exchanger and configured to cool the dielectric cooling fluid circulating through the closed-loop fluid path;

wherein the cooling system is configured to selectively circulate a dielectric cooling fluid through the liquid-to-liquid heat exchanger to extract heat energy from the dielectric transformer fluid based on a liquid-to-liquid transfer of heat energy between the dielectric cooling fluid and the dielectric transformer liquid; and wherein the cooling system functions to lower a temperature of the transformer housing so as to reduce the amount of heat energy radiated to a surrounding external environment, allowing for placement of the transformer indoors of a facility without dumping large amounts of waste heat into the facility, and serving to minimize energy consumption in relation to removing the waste heat from the facility.

13. The transformer of claim 12 further comprising at least one fluid circulation device positioned within the housing and immersed within the dielectric transformer fluid to cause a flow of the dielectric transformer fluid through the core-winding assembly.

14. The transformer of claim 12 wherein the side chamber of the transformer housing is defined by one or more baffles positioned within the transformer housing and a self-enclosed side tank.

15. The transformer of claim 12 further comprising an insulating layer positioned on the housing, the insulating layer configured to contain heat generated by the core-winding assembly within the housing and reduce audible noise generated by the transformer.

16. The transformer of claim 12 wherein the dielectric cooling fluid is a fluid identical to the dielectric transformer fluid.

17. A cooling system for providing cooling to a liquid-filled transformer, the cooling system comprising:

a closed-loop fluid path;

a quantity of cooling fluid contained within the closed-loop fluid path that is circulated there through;

a liquid-to-liquid heat exchanger included in the closed-loop fluid path and being positioned within a housing of the liquid-filled transformer so as to be immersed in a transformer fluid contained within the housing, the liquid-to-liquid heat exchanger configured to cool the transformer fluid based on a liquid-to-liquid transfer of heat energy between the cooling fluid and the transformer fluid; and a heat dissipation system configured to cool the cooling fluid circulating through the closed-loop fluid path, the heat dissipation system being positioned along the closed-loop fluid path remotely from the liquid-to-liquid heat exchanger;

wherein the cooling fluid comprises a first dielectric fluid and the transformer fluid comprises a second dielectric fluid.

18. The cooling system of claim 17 wherein the quantity of cooling fluid contained within the closed-loop fluid path is maintained at a higher pressure than the transformer fluid contained within the housing.

19. The cooling system of claim 17 further comprising at least one additional liquid-to-liquid heat exchanger positioned along the closed-loop fluid path and within the housing so as to be immersed within the transformer fluid, thereby forming a cooling system having a redundant heat exchanger arrangement.

20. The cooling system of claim 17 wherein the cooling system is configured as a retrofitting kit that is addable to an existing transformer, the retrofitting kit comprising:

at least one circulating pump positioned external to the housing and mounted on an external lower flange of the housing; and a manifold positioned external to the housing and mounted on another external lower flange of the housing, the manifold being fluidly connected to the at least one circulating pump;

wherein the at least one circulating pump is configured to pump cooled transformer fluid from a bottom corner region of the housing and to the manifold for circulation through a core-winding assembly of the liquid-filled transformer.

* * * * *